United States Patent [19]

Hamilton

[11] Patent Number: 4,482,131

[45] Date of Patent: Nov. 13, 1984

[54] NAIL EXTRACTOR

[76] Inventor: Frederick D. Hamilton, 5042 Cadiz Cir., La Palma, Calif. 90623

[21] Appl. No.: 378,519

[22] Filed: May 17, 1982

[51] Int. Cl.[3] ..... B25C 11/00

[52] U.S. Cl. ..... 254/18; 81/177 R

[58] Field of Search ..... 254/18, 21, 25; 81/180 R, 177 R; 7/138; 29/254; 145/61 C, 61 J, 61 G

[56] References Cited

U.S. PATENT DOCUMENTS 1,614,628 1/1927 Pym ..... 254/18 X 2,328,737 9/1943 Mushet ..... 254/18

2,522,769 9/1950 Anderson ..... 254/18

3,588,043 6/1971 Griswold ..... 254/18

*Primary Examiner*—Frederick R. Schmidt

*Assistant Examiner*—Steven P. Schad

*Attorney, Agent, or Firm*—Ronald L. Juniper

[57] ABSTRACT

A device for quickly removing nails from boards which includes an elongated rod adapted to drive a nail extractor head having a groove shaped to grip nails embedded in a board. The nails thus engaged by this device are then lifted free from the board by turning the extractor head.

9 Claims, 6 Drawing Figures

NAIL EXTRACTOR

BACKGROUND OF THE INVENTION

Because of the rising cost of labor the paradoxical situation had been reached where it was often not economically feasible to spend the time to remove nails from previously used boards in construction projects. That is, the conventional means for removing nails, such as with a claw hammer, had a greater labor time cost than simply buying new boards. Thus, apparent waste was resulting from disposal of usable boards having nails.

SUMMARY

The nail remover, which is the subject of this invention, solves the problem previously discussed, of time-cost waste of boards not used because they have nails in them which need to be removed. It does this by a unique structure and operation providing advantages in function and economical operation not thought possible previously.

Thus, this invention includes a head having a recessed groove to engage the shank of a nail embedded in a board. This recessed groove is formed in a lifting head connected to a hollow structure adapted to receive a hammer-like device which can smash against this lifting head thereby causing it to engage a nail which is to be removed.

Connected to the hammer is a rod engageable with a rotating mechanism which is adapted to turn the rod and connected hammer-like device so as to cause an engaged nail to be quickly and easily lifted from a board.

DETAILED DESCRIPTION OF A PREFERRED EMBODIMENT OF THE INVENTION

Figure 1:
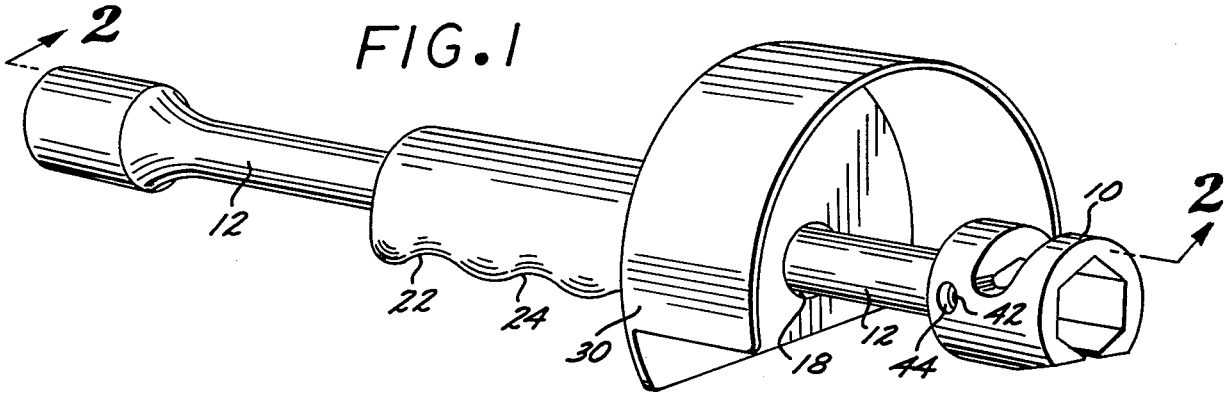
FIG. 1 is an isometric view of a preferred form of this invention showing a cylindrical head with nail-engaging groove attached to a rod.
Figure 2:
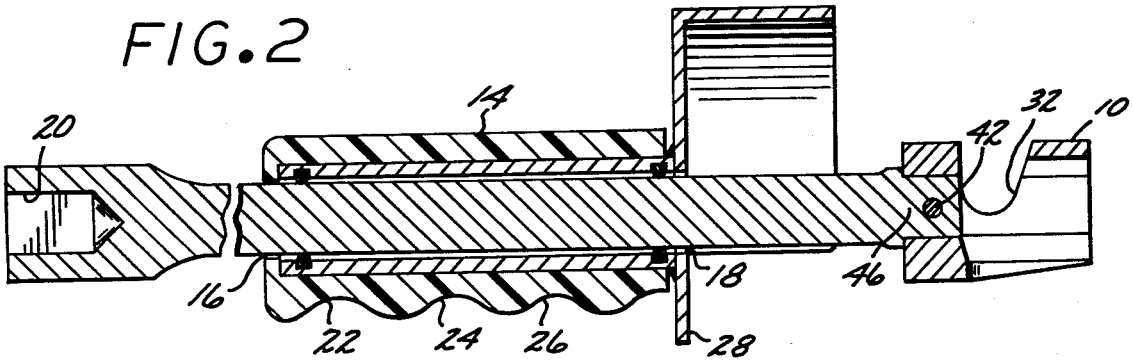
FIG. 2 is a view of the nail extracting device longitudinally sectioned through 2—2 in FIG. 1.
Figure 3:
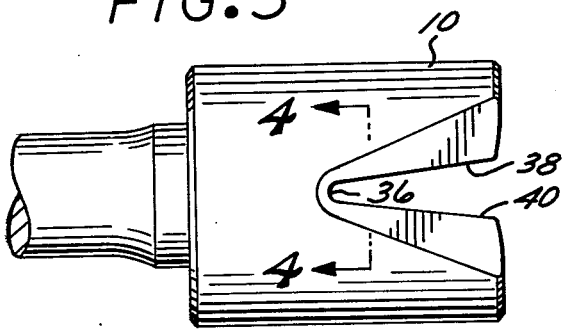
FIG. 3 is a fragmented, isometric top view of the nail extracting head showing the nail-engaging groove.
Figure 4:
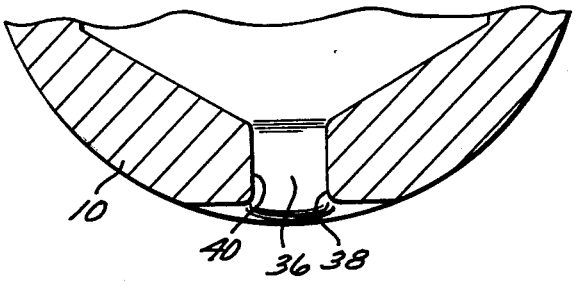
FIG. 4 is a bottom plan view of a fragmented portion of the nail-extracting head taken in section through 4—4 in FIG. 3.

A nail extractor in accordance with this invention includes a nail extractor head 10 connected to a driving rod 12 which is slidably mounted within holding section 14. As shown best in FIG. 2 the holding section 14 is formed as a hollow cylinder slidably mounted over driving rod 12. The portion of rod 12 within holding section 14 is matingly shaped for sliding movement therein.

The rod 12 is provided with a circular cross-sectional configuration and enters holding section 14 through matingly shaped circular holes 16 and 18 in the opposite ends thereof.

The nail extractor head 10 turns as its connected rod 12 is turned. Thus, the end of rod 12 opposite from head 10 is provided with ratchet-socket attaching means 20 which is preferably connected to a powered electric or air impact wrench (not shown) for turning.

The outside of holding section 14 is provided with molded, finger-tip recesses 22, 24 and 26 on one side. A half-disc shaped shield 28 having a forwardly projecting overhanging lip 30 is connected to the holding section 14 end nearest to head 10.

The nail extractor head 10 is formed with a forwardly opening groove 36 formed with inwardly contacting beveled engaging walls 38 and 40 spaced sufficiently far apart to allow entry between them of the upper shank portion of a nail. In order to lift the nail the inward end of groove 36 is small enough to engage the head of the nail.

A viewing slot 32 is cut through the side of head 10 opposite from groove 36 to help align it with a nail to be lifted. The groove 36 is preferably formed with beveled edges to prevent cutting and thereby breaking nails being lifted.

The head 10 is separable from the driving rod 12, but rigidly connectable by attaching means such as through insertion of pin 42 into mating alignable hole 44 in head 10 and hole 46 in rod 12. Thus, different sizes and shapes of heads can be connected to the same hammering section.

As shown, the head 10 is preferably circular in cross-section and formed with a flat bottom surrounding the groove 36 therein which is formed by inwardly slanting engaging walls 38 and 40.

Figure 5:
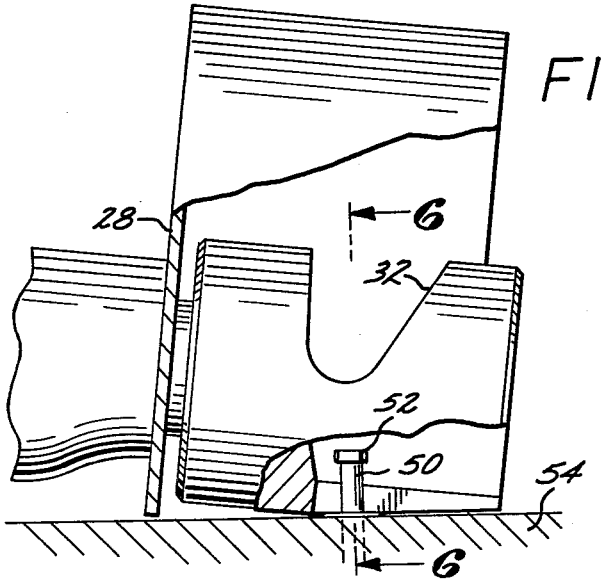
FIG. 5 is a partially fragmented side view of the extractor head engaging a nail embedded in a board as in normal use.

In operation, a powered turning impact wrench (not shown) is engaged with ratchet socket attaching means 20 on the end of rod 14. Then the groove 36 of head 10 engages the upper shank 50 under the head 52 of a nail that is to be removed from a board 54 as shown in FIG. 5. The shank 50 of the nail being removed becomes quickly lodged in the groove 36 of head 10 as it is pushed by rod 12 sliding within holding section 14.

Figure 6:
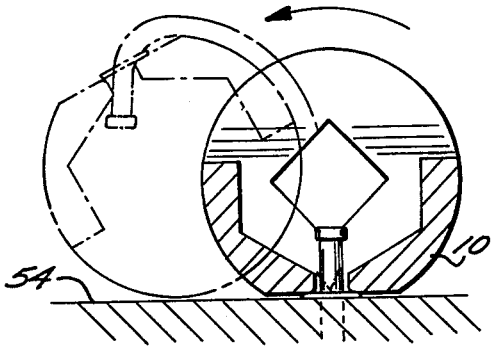
FIG. 6 is a cross-sectional view taken through 6—6 in FIG. 5 showing an engaged nail being extracted as a rotating means (not shown) turns the rod and connected extracting head.

When the nail head 52 is fully engaged within the groove 36, as shown in FIG. 5, it is lifted from board 54. Then the impact wrench (now shown) is momentarily turned on thereby causing a short turn which rolls the connected nail extractor to the side and lifts the engaged nail from the board as shown in FIG. 6.

The device is intended primarily for use with the duplex type nail shown. Also, in addition to the beveled edges on the groove walls 38 and 40, the radius of the circular portion of the head 10 is sufficiently large that it bends the nails as it lifts them, without breaking them. This is best shown in FIG. 6.

Though a preferred embodiment of this invention has been shown and described herein this is not meant as a limitation of this invention but exemplicative only as an illustration of how it might be used and made wherein the scope of forms intended to be covered are defined by the spirit of the following claims.

What is claimed is:

1. A nail extractor for removing a nail embedded in a board including:

an extracting head having a forward end and a rear wall, said forward end provided with a gripping groove adapted to engage the shank of a nail;

an elongated rod having a hammering end and an opposite engaging end;

a rod holding unit adapted to slidably receive said rod so said rod can slide longitudinally and be turned within said rod holding unit;

means for engaging said rod hammering end with said extracting head so that they both turn together in a plane substantially perpendicular to the longitudinal axis of said rod and said gripping groove is positioned for movement in alignment with the said longitudinal axis of said rod wherein, in operation, a user holds said rod holding unit and said rod held therein is slid in the direction of said longitudinal axis within said holding unit until said groove in said extracting head engages and grips the shank of a nail to be removed from a board, said extracting head is generally circular in shape and formed with sufficient radius to bend, without breaking, engaged nails around it, and said nail is then removed by rolling said extracting head to one side by rotating said rod within said rod holding unit sufficiently to lift said nail clear of the board in which it is embedded.

2. A nail extractor as defined in claim 1 wherein said rod holding unit is a hollow circular cylinder shaped as a handle and said rod is a piston matingly shaped to slide and rotate axially therein.

3. A nail extractor as defined in claim 1 wherein said means for engaging said rod hammering end with said extracting head includes an opening conformingly shaped to said rod hammering end's cross-sectional shape.

4. A nail extractor as defined in claim 1 wherein said extracting head is provided with an opening in the side thereof opposite from said gripping groove, said opening being aligned for viewing said groove.

5. A nail extractor as defined in claim 1 wherein there is a space on the end of said gripping groove adapted to receive the shank of a nail to be extracted and to hold the head of said nail above said groove so as to be engaged for removal.

6. A nail extractor as defined in claim 1 wherein said extracting head is detachable from said rod.

7. A nail extractor as defined in claim 1 which includes turning means adapted to engage with and turn the engaging end of said rod.

8. A nail extractor as defined in claim 7 wherein the turning means is a powered impact-twisting wrench.

9. A nail extract as defined in claim 1 wherein said gripping groove is formed by inwardly slanting beveled engaging walls and said rod holding unit is formed with a hand guard element.

* * * * *